United States Patent [19]

Horn

[11] Patent Number: 4,700,920

[45] Date of Patent: Oct. 20, 1987

[54] GLIDER SUPPORT ASSEMBLY

[75] Inventor: John Horn, London, Canada

[73] Assignee: Lear Siegler, Inc., Berkley, Mich.

[21] Appl. No.: 13,209

[22] Filed: Feb. 6, 1987

Related U.S. Application Data

[63] Continuation-in-part of Ser. No. 660,709, Oct. 15, 1984, abandoned.

[51] Int. Cl.[4] ..... A47G 29/00

[52] U.S. Cl. ..... 248/370; 297/281

[56] References Cited

U.S. PATENT DOCUMENTS

| | | | |
|---|---|---|---|
| 26,032 | 11/1859 | Harris . | |
| D. 121,461 | 7/1940 | Tabb . | |
| 331,634 | 12/1885 | Hall et al. . | |
| 383,808 | 5/1888 | Hall . | |
| 413,140 | 10/1889 | Hall . | |
| 675,480 | 6/1901 | Heinlin | 248/370 |
| 908,689 | 1/1909 | McVey | 248/370 |
| 929,207 | 7/1909 | Gerlach | 248/370 |
| 1,210,739 | 1/1917 | Warner . | |
| 1,965,785 | 7/1934 | Vallone . | |
| 2,256,004 | 9/1941 | Thomas | 248/424 X |
| 2,284,571 | 5/1942 | Heller . | |
| 2,302,387 | 11/1942 | Greeno et al. . | |
| 2,529,613 | 11/1950 | Kirkwood et al. . | |
| 3,047,334 | 7/1962 | Vanderminden | 297/281 |
| 3,994,468 | 11/1976 | Carter et al. . | |
| 4,108,415 | 8/1978 | Hauray et al. . | |
| 4,213,650 | 7/1980 | Sroub | 297/281 |

*Primary Examiner*—Ramon S. Britts
*Assistant Examiner*—Sarah A. Lechok Eley
*Attorney, Agent, or Firm*—Brooks & Kushman

[57] ABSTRACT

A glider support assembly (10, 10') for a chair (12) or other similar article of furniture includes a lower floor base (14, 14'), an upper frame (18) for attaching the chair, suspension links (20) that support the chair frame (18) on the base (14, 14') for forward and rearward gliding movement, and stops (26, 28) preferably on the suspension links and supports (34) of the base in order to position the chair in a reclined position without any latch mechanism. Detachable connections (22, 24) of the suspension links (20) permit the support assembly to be stored, shipped, and sold disassembled in a knock-down fashion. Stops (30, 32) are also provided to limit excessive forward movement of the chair on the support assembly. In one embodiment of the support assembly (10), the supports (34) are constructed as bent metal brackets that project upwardly. In another embodiment of the support assembly (10'), the supports (34) are constructed as tubular metal support beams (116) from which front and rear legs (122, 124) project downwardly.

14 Claims, 14 Drawing Figures

GLIDER SUPPORT ASSEMBLY

This is a continuation-in-part of co-pending application Ser. No. 660,709, now abandoned, filed on Oct. 15, 1984.

TECHNICAL FIELD

This invention relates to a glider support assembly for a chair or other similar article of furniture such as a sofa, or loveseat, etc.

BACKGROUND ART

While most chairs or other similar articles of furniture utilize rockers to provide relaxing movement of a seated individual or individuals, glider support assemblies have also been used for many years to provide forward and rearward movement in a generally translatory manner without substantial rotation. See, for example, the carriage seat disclosed by U.S. Pat. No. 26,032 which utilized this type of movement well over a hundred years ago.

Most glider support assemblies have previously been utlized with outdoor or lawn type furniture such as shown by U.S. Pats. Nos. D. 121,461, 3,994,468, and 4,108,415. However, glider support assemblies have also been utilized with upholstered furniture intended for indoor use, such as shown by U.S. Pats. Nos. 331,634, 1,210,739, 2,284,571, and 2,529,613. Antifriction bearings have been incorporated with suspension links of such glider support assemblies to facilitate forward and rearward gliding movement such as disclosed by U.S. Pat. No. 1,965,785.

Unlike furniture rocker assemblies which conventionally incorporate a reclined position, very few glider support assemblies have previously incorporated a reclined position in addition to providing forward and rearward gliding movement. Prior glider support assemblies which have incorporated a reclined position have all utilized a positive mechanical latching type mechanism for holding the support assembly in the reclined position such as shown by U.S. Pat. Nos. 383,808, 413,150, and 2,302,387.

DISCLOSURE OF INVENTION

An object of the present invention is to provide an improved glider support assembly for supporting a chair or other similar article of furniture for forward and rearward gliding movement and for positioning in a reclined position in which the chair is held by the rearwardly inclined weight without requiring any mechanical latch mechanism or the like.

In carrying out the above object, one component of the glider support assembly constitutes a floor base that projects upwardly and may include lower fixed legs or a swivel depending upon the type of movement that is desired. Another component of the support assembly constitutes an upper frame that is attachable to the chair and projects downwardly in a vertically overlapping relationship with the floor base. Suspension link components of the support assembly extend downwardly from the floor base to the frame and have pivotal connections thereto to support the upper frame and chair attached thereto for forward and rearward gliding movement and for positioning in a reclined position. Two of the components of the support assembly have cooperable stops that are forced against each other in the reclined position by the rearwardly inclined weight of the chair and its occupant to hold the chair in the reclined position.

In the preferred construction of the glider support assembly, the cooperable stops are positioned on the floor base and the suspension links such that movement of the suspension links as the chair is reclined forces the stops into engagement with each other to hold the chair in the reclined position by the rearwardly inclined weight of the chair and its occupant. Additional stops are also provided on the suspension links and the floor base to limit forward movement of the upper frame and the attached chair.

The preferred construction of the glider support assembly includes a floor base having a pair of laterally spaced supports that project upwardly. A pair of laterally spaced front suspension links respectively extend downwardly from the pair of laterally spaced supports of the base to support the upper frame at its front end. Another pair of laterally spaced rear suspension links respectively extend downwardly from the pair of laterally spaced supports of the base to support the rear end of the upper frame and thereby cooperate with the front suspension links in supporting the upper frame for its forward and rearward gliding movement as well as positioning the frame in the reclined position.

In one preferred embodiment, each support of the base comprises a bracket having a forward projection on which the associated front suspension link is mounted. A stop portion of each support bracket functions as the base stop in cooperation with the stop portion of the other bracket. Each front suspension link also has a stop portion that functions as the suspension link stop in cooperation with the stop portion of the other front suspension link. A front rod extends between the front suspension links and has opposite ends that function as the link stop portions for engaging the stop portions on the support brackets. The forward projection of each support bracket preferably has a rearward portion with a lower side at which the base stop portion thereof is located and engaged by the link stop portion on the adjacent end of the front rod in the reclined position.

In the one preferred embodiment, each support bracket of the floor base also includes a rearward projection having a rearward portion on which the associated rear suspension link is mounted. A forward stop portion on each support bracket is also preferably provided along with a stop portion on each rear suspension link to provide stops whose engagement prevents excessive forward movement of the upper frame and the chair supported by the frame. A rear rod of the assembly preferably extends between the rear suspension links and has opposite ends that function as the stop portions of the rear links. The rearward projection of each support bracket has a forward portion with a lower side at which the forward stop portion thereof is located and engaged by the opposite ends of the rear rod to limit the forward movement.

In a second preferred embodiment, the supports of the base include a pair of generally horizontally extending support beams having front and rear ends including downwardly extending legs. The support beam and legs of each support are preferably made from a unitary tube which is bent at the junctions of the beam ends and the legs. The tubular support beam of each support has a lower surface that defines the base stop portion which functions as the base stop in cooperation with the base stop portion of the other support. Each front suspension link has a stop portion that functions as the suspension link stop in cooperation with the stop portion of the other front suspension link. A front rod extends between the front suspension links and has opposite ends that function as the front link stop portions.

In the second preferred embodiment, the lower surface of each support beam also defines a forward stop portion that functions as a forward stop. Each rear suspension link has a stop portion that functions as a suspension link stop for engaging the forward stop on the associated support beam to limit forward movement of the upper frame and hence the chair supported on the upper frame. A rear rod extends between the rear suspension links and has opposite ends that function as the stop portions of the rear links.

In both preferred embodiments, the upper frame for supporting the chair includes a pair of elongated members that are spaced laterally with respect to each other. Each elongated member includes front and rear legs or leg portions that project downwardly therefrom and are respectively connected to the associated front and rear suspension links to provide the support of the upper frame. As disclosed, the elongated members each have a horizontal flange on which the chair is supported and a vertical flange to which the associated pair of legs are secured.

In a modification also usable with either of the embodiments, the upper frame includes a pair of unitary metal members each of which has an upper horizontal flange that defines the elongated member, and each unitary metal member also has a vertical flange that defines the front and rear leg portions. These unitary metal members are preferably made as stampings and also preferably include stamped ribs that provide strengthening. The stamped ribs are defined as vertical ribs extending along the leg portions, X-shaped ribs extending between the upper and lower ends of the vertical ribs, and a horizontal rib extending along the lower edge of each stamped metal member generally parallel to its horizontal flange.

To further enhance its utility, the glider support assembly also has a knockdown construction. Specifically, each suspension link has detachable connections to the base and the upper frame such that the support assembly can be stored, shipped, and sold disassembled. These detachable connections of the suspension links preferably each include an antifriction bearing and a threaded connection that provide connection of the associated suspension link to the base or the frame. Opposite ends of each suspension link include unitary tangs that are deformable to secure the antifriction bearing of the associated connection in a cost efficient manner. In addition to the detachable connections of the suspension links, the floor base also preferably includes detachable connections and separable components secured thereby such that the components of the base can be stored, shipped, and sold disassembled.

The objects, features, and advantages of the present invention are readily apparent from the following detailed description of the best modes for carrying out the invention when taken in connection with the accompanying drawings.

BEST MODES FOR CARRYING OUT THE INVENTION

Figure 1:
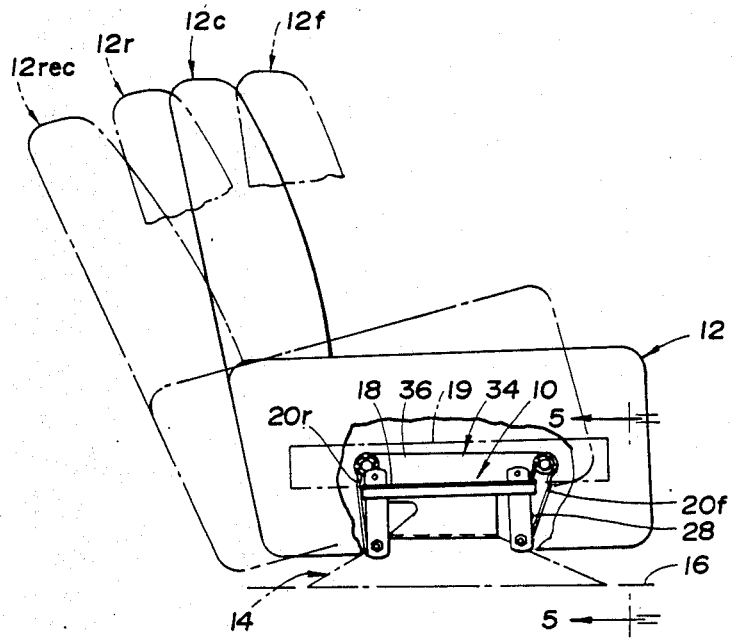
FIG. 1 is a side view of one preferred embodiment of a glider support assembly constructed in accordance with the present invention and shown utilized with a chair that is movable forwardly and rearwardly for gliding movement and positionable in a reclined position.

With reference to FIG. 1 of the drawings, one preferred embodiment of a glider support assembly constructed in accordance with the present invention is indicated generally by 10 supporting an upholstered chair 12. This glider support assembly can also be utilized with other similar articles of furniture in addition to chairs such as love seats, sofas, or other furniture intended to seat more than a single person as is the case with chairs. In use, the glider support assembly 10 supports the chair 12 for forward and rearward gliding movement between the forward position **12*f* and the rearward position 12*r* while passing through the center position 12*c* to which the chair is normally biased by its weight and the weight of any seated person. In addition, as is hereinafter more fully described, the chair is movable to the reclined position 12*rec*** where it is held by the rearwardly inclined weight without requiring any mechanical latch mechanism or the like to position the chair.

Figure 2:
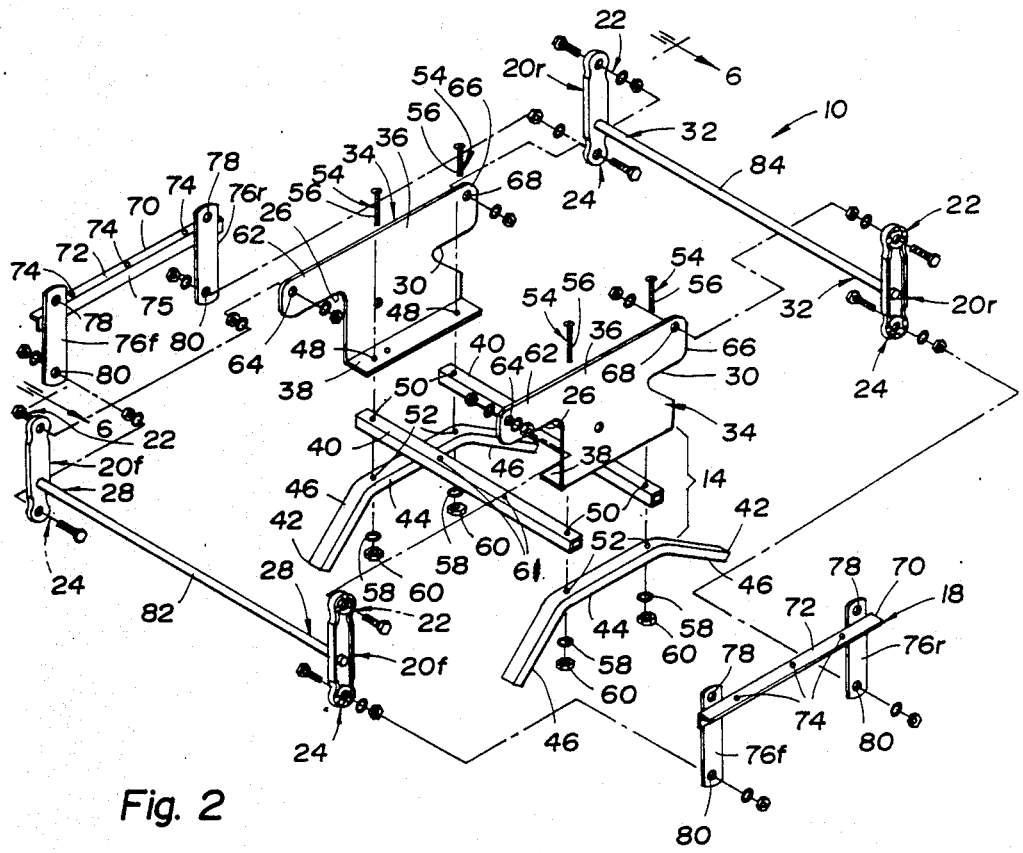
FIG. 2 is an exploded disassembled view of the glider support assembly.
Figure 5:
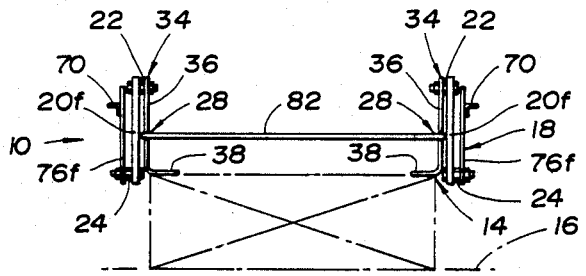
FIG. 5 is a front view of the support assembly taken along the direction of line 5—5 in FIG. 1.
Figure 6:
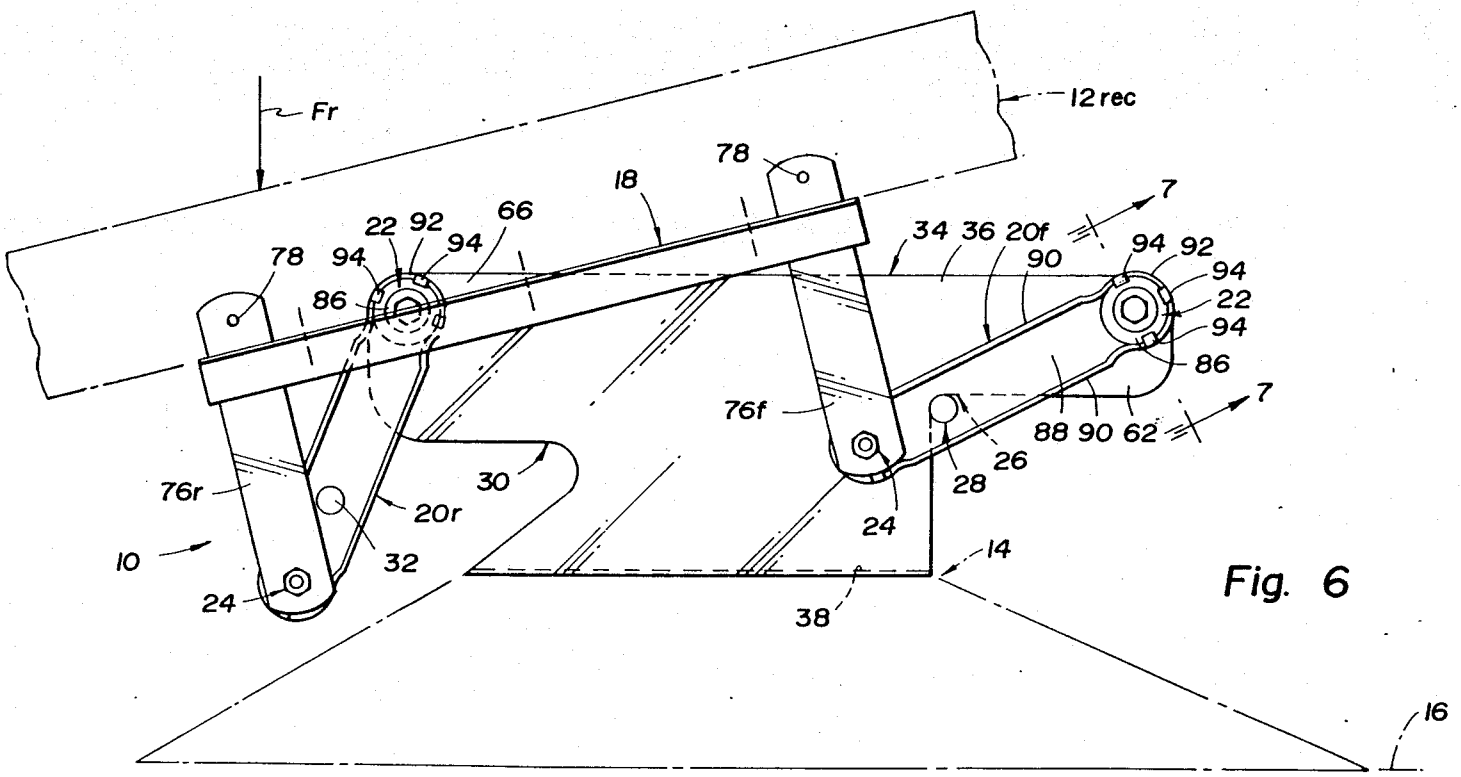
FIG. 6 is an enlarged side view of the support assembly taken in the same direction as FIG. 1 and shown in the reclined position.

As illustrated in FIGS. 1, 2, and 5, the glider support assembly 10 includes one component that constitutes a lower floor base 14 designed to sit on the floor 16 and project upwardly therefrom as illustrated. Another component of the support assembly 10 constitutes an upper frame 18 that is attachable to a wooden frame 19 (FIG. 1) of the chair 12 and projects downwardly therefrom in a vertically overlapping relationship with the floor base 14. Additional components of the support assembly 10 are constituted by suspension links 20 that extend downwardly from the floor base 14 to the chair frame 18. Each suspension link 20 has an upper end including a pivotal connection 22 to the floor base 14, and each suspension link 20 also has a lower end including a pivotal connection 24 to the chair frame 18. The suspension links cooperate to support the upper chair frame 18 on the floor base 14 for forward and rearward gliding movement as illustrated in FIG. 1 between the positions 12*f* and 12*r*. A pair of cooperable stops 26 and 28 which are best shown in FIG. 6 are also provided on two different components of the support assembly 10 and are preferably located on the floor base and suspension link components 14 and 20. These stops 26 and 28 are forced against each other in the reclined position 12rec illustrated in FIG. 1 by the rearwardly inclined weight of the chair and its occupant in order to hold the chair in the reclined position as is hereinafter more fully described.

Figure 4:
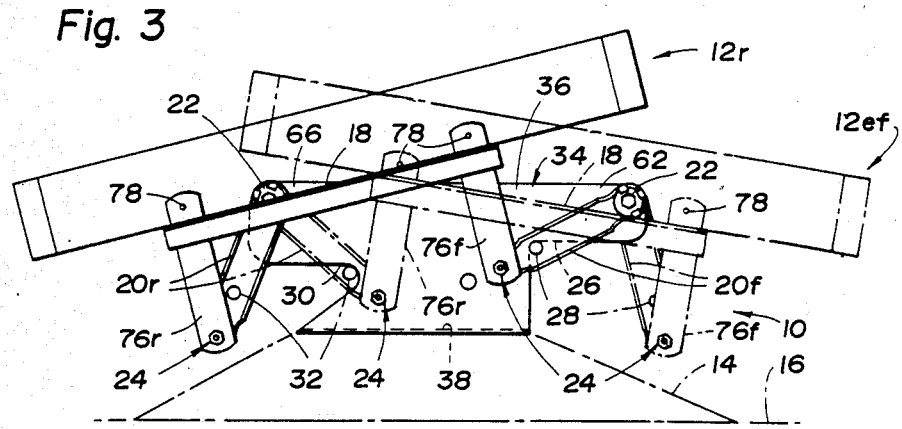
FIG. 4 is a side view of the support assembly similar to FIG. 3 but with an upper frame and suspension links of the assembly shown in the reclined position by solid line representation and at the forwardmost position by phantom line representation.

As illustrated in FIG. 4, another pair of cooperable stops 30 and 32 are also located on the floor base and suspension link components 14 and 20. These additional stops 30 and 32 are engaged with each other upon movement of the chair to an extreme forward position 12ef as shown in FIG. 4 in order to limit the forward movement and thereby prevent the chair from tipping excessively forward.

As illustrated in FIG. 2, the floor base 14 includes a pair of laterally spaced supports 34 that project upwardly and are embodied by bent metal brackets. Each support bracket 34 includes a vertically extending support portion 36 and a horizontally extending lower flange 38 that extends in a perpendicular relationship to the associated support portion. Base 14 also includes a pair of cross braces 40 that are made from tubular metal of a square cross section. These cross braces 40 extend between the lower flanges 38 of the support brackets 34 in the assembled condition. In addition to the cross braces 40, the base 14 also includes a pair of leg members 42 also made from tubular metal of a square cross section. Leg members 42 are each bent to include an upper horizontally extending beam 44 and a pair of inclined legs 46 extending downwardly from the opposite ends of the associated beam. A pair of holes 48 in the lower flange 38 of each support bracket 34 are aligned with a pair of holes 50 in the adjacent ends of the cross braces 40 and with a pair of holes 52 in the beam 44 of the adjacent leg member 42 upon assembly. Detachable connections 54 extend through the aligned sets of holes 48, 50, and 52 to secure the separate components of the base 14 to each other. Each detachable connection 54 includes a bolt 56 that extends through the holes and also includes a lock washer 58 and a nut 60 for securing the detachable connections. The detachable connections and the separate components of the base allow the base to be stored, shipped, and sold disassembled in order to reduce storage and shipping costs.

It should also be noted that the base 14 can be utilized with a swivel support instead of the fixed leg support illustrated. In this connection, each of the cross braces 40 is provided with a pair of central holes 61 as shown in FIG. 2 for permitting securement of the swivel support to the rest of the base by suitable detachable connections that also allow the base to be stored, shipped, and sold disassembled to conserve storage and shipping costs. When utilized with a swivel support, there are no leg members 42 and the detachable connections 54 thus only secure the lower support bracket flange 38 to the adjacent ends of the cross braces 40. Normally, shorter bolts 56 will then be utilized with the detachable connections 54 since the great length is not necessary.

As best illustrated in FIG. 2, the support portion 36 of each support bracket 34 includes a forward projection 62 whose forward outer end includes a hole 64 and whose rearward end portion at its lower side defines the stop 26. The support portion 36 of each support bracket 34 also includes a rearward projection 66 whose rearward outer end includes a hole 68 and whose forward end portion at its lower side defines the stop 30.

Figure 3:
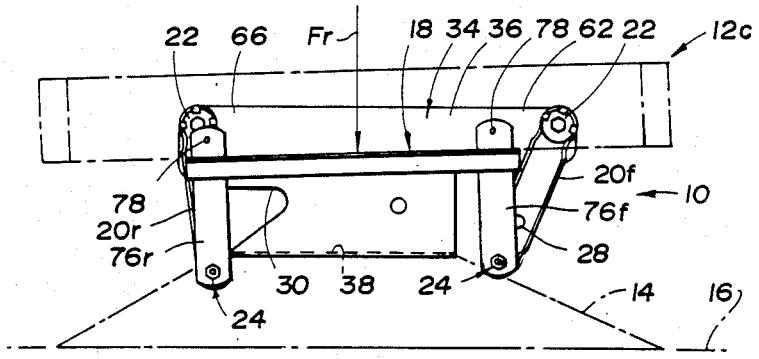
FIG. 3 is an enlarged side view of the glider support assembly taken in the same direction as FIG. 1 and illustrating the assembly at a neutral position.

Chair frame 18 of the support assembly 10 is illustrated in FIGS. 2, 3, and 5 as including a pair of elongated members 70 that are spaced laterally with respect to each other outboard from the support brackets 34. Elongated members 70 are each of an angle iron construction including a horizontal flange 72 that supports the associated chair frame and has holes 74 through which screws or the like can be inserted to provide securement to the chair. Each elongated member 70 also includes a vertical flange 75 that extends in a perpendicular relationship to the horizontal flange 72. At the forward and rearward ends of each elongated member 70, the frame 18 is provided with a pair of front and rear vertically extending legs portions or legs 76*f* and 76*r*. Upper ends of these legs include holes 78 through which screws or the like are inserted to further secure the associated chair to the frame 18. Adjacent their upper ends, the legs are secured to the vertical flange 75 of the associated elongated member 70 in a suitable manner such as by welding. Lower ends of the legs are provided with holes 80 utilized to secure the suspension links.

As best seen in FIG. 2, support assembly 10 includes a front pair of the suspension links 20*f* that are spaced laterally with respect to each other and located between the adjacent support bracket 34 of base 14 and the adjacent front legs 76*f* of the frame 18. Pivotal connections 22 connect the upper ends of the front suspension links 20*f* to the forward projections 62 of the support brackets 34 by extending through the holes 64 thereof in a manner which is hereinafter more fully described. Pivotal connections 24 connect the lower ends of the front suspension links 20*f* to the lower ends of the adjacent vertical legs 76*f* of the frame 18 by extending through the holes 80 thereof in a manner which is likewise hereinafter more fully described. A front rod 82 extends between the pair of front suspension links 20*f* and has opposite ends which are inserted through holes in the intermediate portions of these links for securement by welding. Adjacent the front suspension links 20*f*, the opposite ends of the rod 82 define the stops 28 that engage the support bracket stops 26 as previously described in the rearwardly inclined position. Such engagement thus takes place at each lateral side of the support assembly in a symmetrical fashion.

As illustrated in FIGS. 2, 3, and 4, support assembly 10 also includes a rear pair of suspension links 20*r* which are spaced laterally with respect to each other at each side of the assembly between the adjacent support bracket 34 of the base 14 and the rear legs 76*r* of the chair frame 18. Upper ends of the rear suspension links 20*r* are secured to the support brackets 34 by the pivotal connections 22 to the rearward projections 66 thereof through the holes 76 in a manner which is hereinafter more fully described. Likewise, the lower ends of the rear suspension links 20*r* are secured by the pivotal connections 24 to the lower ends of the vertical legs 76*r* of frame 18 through the holes 80 in a manner which is hereinafter more fully described. A rear rod 84 extends between the pair of laterally spaced rear suspension links 20*r* and has opposite ends that project through holes in the rear suspension links for securement by welding in the same manner as the front rod 82 of the assembly. Just inboard from the rear suspension links 20*r*, the opposite ends of the rear rod 84 define the stops 32 that engage the support bracket stops 30 as previously described to prevent excessive forward movement of the chair.

With combined reference to FIGS. 6 and 7, the pivotal connections 22 and 24 of the suspension links 20*f* and r are of the detachable type to provide the support assembly with knockdown capability in addition to the knockdown capability previously described in connection with the components of the base. The support assembly thus has further knockdown capability to permit its storage, shipping, and sale disassembled in order to reduce storage and shipping costs.

Figure 7:
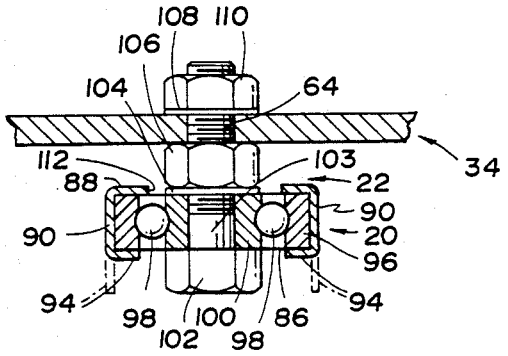
FIG. 7 is a sectional view taken along line 7—7 of FIG. 6 and illustrates detachable pivotal connections of the suspension links of the assembly.

One of the detachable pivotal connections 22 is illustrated in FIG. 7 and is illustrative of the other detachable pivotal connections 22 and 24 as well. Each of these detachable connections includes an antifriction bearing 86 supported on the end of the associated suspension link 20. The suspension links are stamped to include a main wall 88 and side walls 90 that define a channel shape for receiving the bearing 86. At the opposite link ends as illustrated in FIG. 6, a connector side wall 92 extends between the side walls 90 for just slightly more than 180 degrees in order to form a pocket that captures the bearing 86 against movement toward the opposite end of the link. Connector side wall 92 also includes three tangs 94 that are unitary with the suspension links and initially assume the phantom line position shown in FIG. 7 to permit the antifriction bearing 86 to be inserted into the channel shape of the link end. Tangs 94 are deformed to the solid line position of FIG. 7 to secure the outer race 96 of the antifriction bearing 86. Ball elements 98 support the outer bearing race 96 with respect to the inner race 100 such that the gliding movement of the chair is provided in an antifriction maner.

With continuing reference to FIG. 7, the detachable pivotal connection 22 includes a threaded bolt 102 whose head engages the inner race 100 of the antifriction bearing 86 and whose shank 103 extends through the center of the inner race and through the associated hole 64 in the support 34. A lock washer 104 and nut 106 secure the bolt 102 with respect to the inner bearing race 100 on one side of the support 34. Another lock washer 108 and nut 110 secure the bolt on the opposite side of the support 34 to complete the detachable connection. Adjacent the washer 104 and nut 106, the base wall 88 of the link includes an opening 112 of sufficient size so that there is no engagement between the link and the detachable connection 22 in order to permit the support of the link to be provided solely by the antifriction bearing 86.

When the support assembly 10 is in a stationary condition or during normal forward and rearward gliding movement, the resultant force Fr as illustrated in FIG. 3 will be applied to the frame 18 in a general downward direction between the front and rear sets of pivotal connections 22 and 24 of the suspension links 20*f* and *r*. As such, the resultant force will then always tend to move the chair toward its center position 12*c* where the suspension links extend toward each other a slight extent in the downward direction. To shift the chair to the reclined position, the occupant will shift weight rearwardly upon a rearward movement so that the resultant force Fr moves as shown in FIG. 6 to the rear of the lower pivotal connections 24 between the rear suspension links 20*r* and the rear legs 76*r* of the frame 18. Such movement of the resultant force Fr produces a counterclockwise torque on the frame 18 about the pivotal connections 24 and thereby tends to pull the forward end of the frame 18 upwardly to engage the suspension link stop 28 with the support bracket stop 26. Such engagement maintains the chair in the reclined position until the occupant shifts weight forwardly to move the resultant force Fr forward of the lower pivotal connections 24 of the rear suspension links 20*r* whereupon the upward force of the front end of the frame 18 is changed to a downward force and normal gliding movement takes place.

With reference o FIGS. 8 through 12, another preferred embodiment of a glider support assembly constructed in accordance with the present invention is indicated generally by reference numeral 10'. Except as will be noted, this glider support assembly 10' is similar to the previously described embodiment and has like reference numerals applied to like components thereof such that much of the previous description is applicable and need not be repeated.

Figure 8:
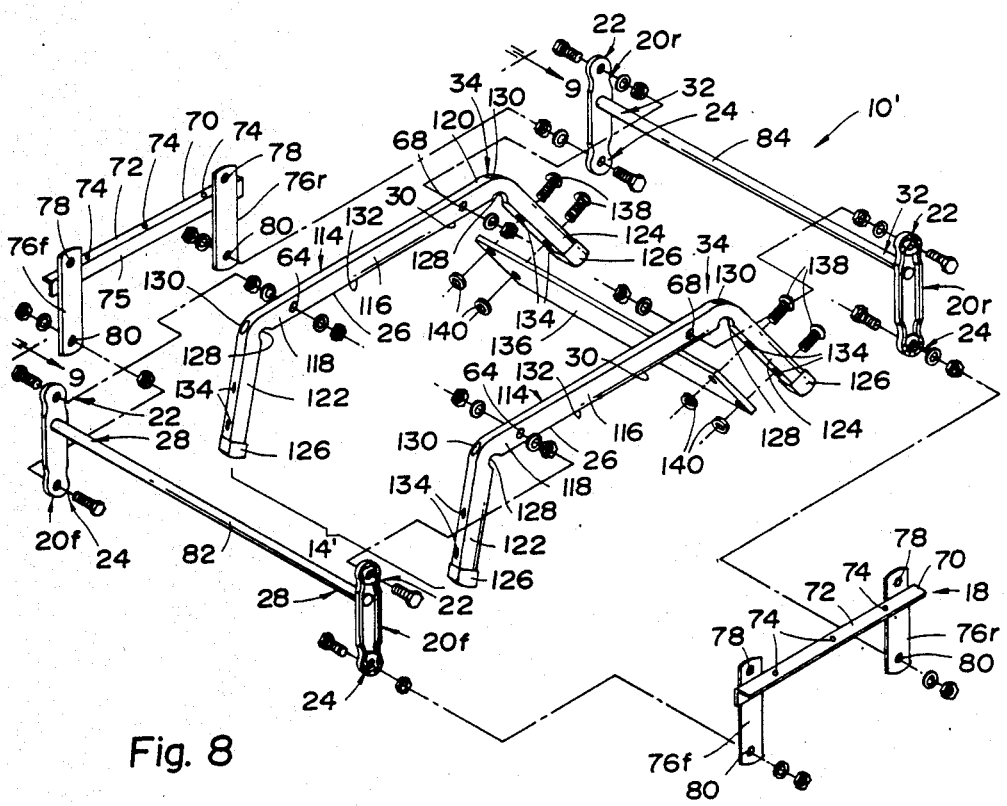
FIG. 8 is an exploded disassembled view of a second preferred embodiment of the glider support assembly.

As illustrated in FIG. 8, the glider support assembly 10' includes a floor base 14' which has a different construction than the floor base of the previously described embodiment. Otherwise, the construction of the glider support assembly 10' is the same as the previously described embodiment. Thus, the upper frame 18 and the suspension links 20*f* and *r* as well as the front and rear rods 82 and 84 and the stops thereof are all generally the same as the previously described embodiment and the construction thereof need not be repeated.

Figure 9:
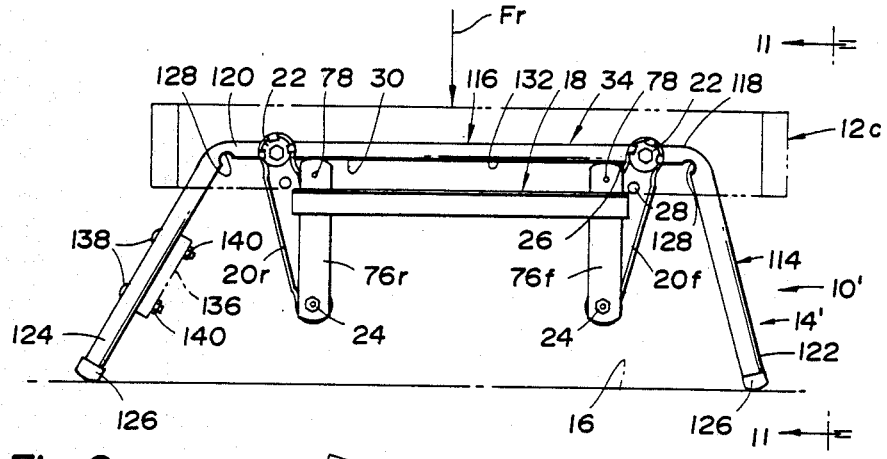
FIG. 9 is a side view of the second embodiment of the glider support assembly taken along the direction of line 9—9 in FIG. 8 and illustrated with the assembly at a neutral position.
Figure 10:
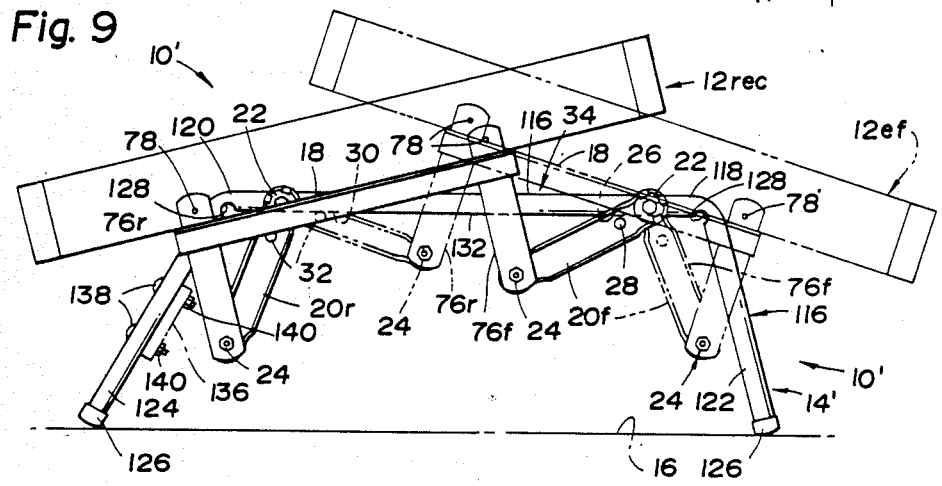
FIG. 10 is a side view of the second embodiment of the support assembly similar to FIG. 9 but with an upper frame and suspension links of the assembly shown in the reclined position by solid line representation and at the forwardmost position by phantom line representation.
Figure 11:
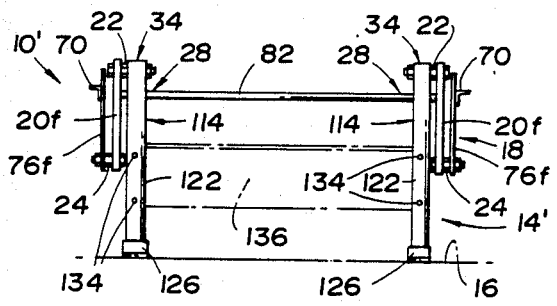
FIG. 11 is a front view of the support assembly taken along the direction of line 11—11 in FIG. 9.

As best illustrated in FIGS. 8, 9, and 11, the floor base 14' of assembly 10' includes a pair of laterally spaced supports 34 that project upwardly in a vertically overlapping relationship with the upper frame 18 to provide support for the upper ends of the suspension links 20*f* and *r*. Each base support 34 comprises a tubular base member 114 that includes a horizontally extending support beam 116 extending in a front to rear direction. Front and rear ends 118 and 120 of each support beam 116 include downwardly extending front and rear legs 122 and 124 whose lower ends receive floor cups 126 made from rubber or a rubber-like plastic. As disclosed, the tubular base members 114 each have a rectangular cross section of a square shape. Adjacent the junction of the upper end of each leg 122 and 124 with the adjacent end 118 or 120, respectively, of the ends of the support beam 116, the base members 114 are deformed at 128 and 130 (FIG. 8) to facilitate the downward bending of the legs to the shape shown. As illustrated, the front legs 122 are somewhat more vertical than the rear legs 124 in order to permit the support assembly to position the chair in the reclined position.

As best illustrated in FIG. 8, the front and rear ends 118 and 120 of each support beam 116 include openings 64 and 68 through which the detachable connections 22 secure the upper ends of the suspension links 20*f* and *r*, respectively. The suspension links 20*f* and *r* support the upper frame 18 on the support beam 116 for positioning in the neutral or center position illustrated in FIG. 9 and for forward and rearward gliding movement.

With reference back to FIG. 8, the support beam 116 includes a lower surface 132 that defines a rear stop 26 just rearward from the hole 64 that supports the upper end of the associated front link 20*f*. As is hereinafter described the stops 26 on the support beams 116 are engaged by the front link rod end stops 28 in the same manner as the previously described embodiment to position the upper frame 18 and the chair attached thereto in the reclined position 12*rec* illustrated in FIGS. 10 and 12. The lower surface 132 of each support beam 116 also defines a forward stop 30 just forward of the associated hole 68 by which the upper end of the associated rear link 20*r* is supported. Stops 30 on the support beams 116 are engaged by the rod end stops 32 of the rear rod 84 to limit forward movement of the chair in the extreme forward position 12*ef* illustrated in FIG. 10 by phantom line representation.

As illustrated in FIGS. 8 and 11, the front and rear legs 122 and 124 of each base member 124 include a pair of holes 134 for attaching cross members. Such cross members may be made of scrap wood and thus do not have to be sold as an original component of the support assembly although it is possible to do so. As illustrated in FIG. 8, the cross member is identified by 136 and is secured by bolts 138 and nuts 140 to the rear legs 124. In other instances, it may be desirable to secure a cross member to the front legs 122 instead of the rear legs 124 or to both the front and rear legs.

As illustrated in FIG. 11, the upwardly projecting base members 114 defined by the tubular members are located inboard from the front suspension links 20*f* as well as from the unshown rear suspension links, all of which are located inboard from the elongated members 70 of the upper frame 18. The front and rear rods 82 and 84 (FIG. 8) on which the stops 28 and 32 are respectively located thus extend underneath the lower surface 132 of the adjacent support beam 116 to engage the stops 26 and 30 in the extreme rearward and forward positions.

Figure 12:
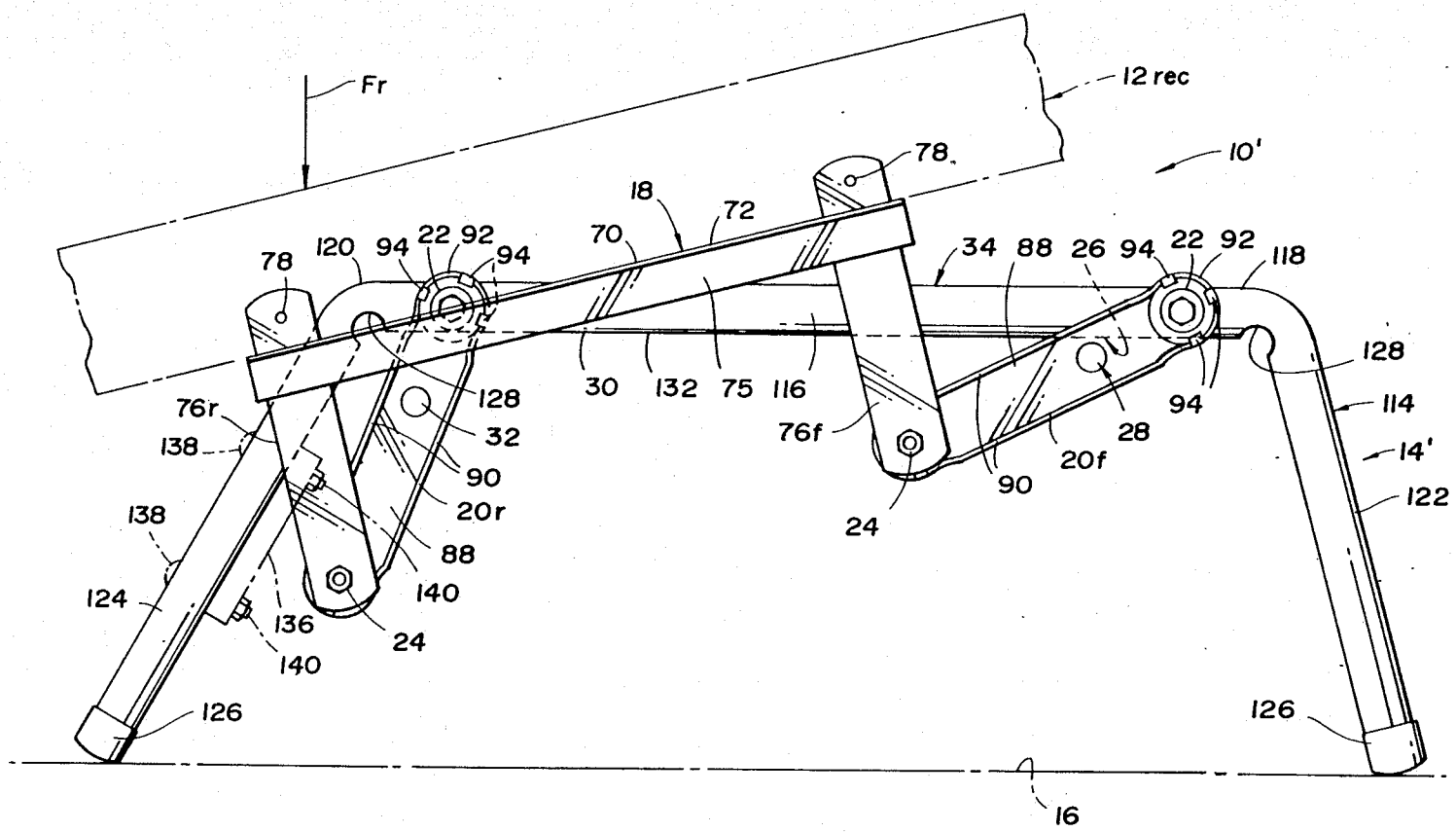
FIG. 12 is an enlarged view of the support assembly taken in the same direction as FIGS. 9 and 10 and shown in the reclined position.

When the support assembly 10' is in a stationary condition or during normal forward and rearward gliding movement, the resultant force Fr as illustrated in FIG. 9 will be applied to the frame in a generally downward direction between the front and rear sets of pivotal connections 22 and 24 of the suspension links 20*f* and *r*. As such, the resultant force will always tend to move the chair toward its center position 12*c* where the suspension links extend toward each other a slight extent in the downward direction. To shift the chair to the reclined position, the occupant will shift weight rearwardly upon a rearward movement so that the resultant force Fr moves as shown in FIG. 12 to the rear of the lower pivotal connections 24 between the rear suspension links 12*r* and the rear legs 76*r* of the frame 18. Such movement of the resultant force Fr produces a counterclockwise torque on the frame 18 about the pivotal connections 24 and thereby tends to pull the forward end of the frame 18 upwardly to engage the suspension link stops 28 with the stops 26 defined by the lower surface 132 of the support beam 116. That engagement maintains the chair in the reclined position until the occupant shifts weight forwardly to move the resultant force Fr forward of the lower pivotal connections 24 of the rear suspension links 20*r* whereupon the upward force of the front end of the frame 18 is changed to a downward force and normal gliding movement takes place.

Figure 13:
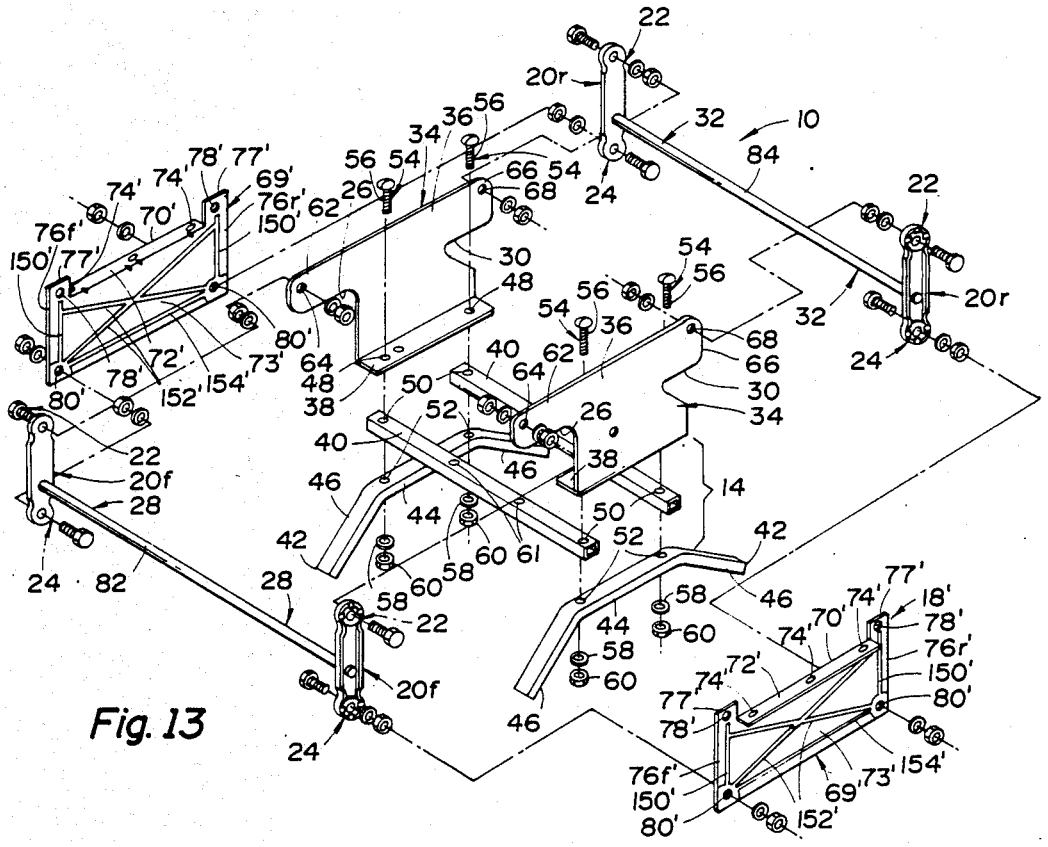
FIG. 13 is a perspective view similar to FIG. 2 illustrating a modified version of the upper frame of the glider support assembly.
Figure 14:
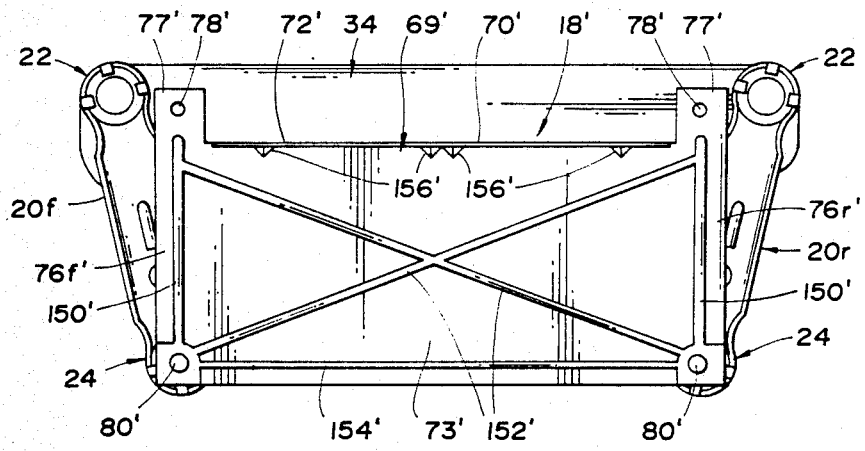
FIG. 14 is a side view of the modified version of the upper frame.

With reference to FIGS. 13 and 14, a modified version 18' of the upper frame is illustrated as being used with the embodiment of FIGS. 1 through 7. However, it should be appreciated that this modified version of the upper frame 18' is also usable with the embodiment of FIGS. 1 through 12.

While the best modes for carrying out the invention have been described in detail, those familiar with the art to which this invention relates will recognize various alternatives, designs, and embodiments for practicing the present invention as defined by the following claims.

What is claimed is:

1. A glider support assembly for a chair or other similar article of furniture, comprising: a lower floor base including a pair of laterally spaced supports that project upwardly; each support having downwardly facing front and rear base stop portions that respectively provide front and rear base stops; an upper frame including a pair of laterally spaced elongated members that extend horizontally so as to be attachable to the chair; the upper frame also including front and rear legs portions projecting downwardly from each elongated member in a vertically overlapping relationship with the upwardly projecting supports of the floor base on the outboard sides of the supports; a pair of laterally spaced front suspension links that respectively extend downwardly from the pair of supports of the floor base to the adjacent front leg portions of the upper frame and have pivotal connections thereto; a pair of laterally spaced rear suspension links that respectively extend downwardly from the pair of supports of the floor base to the adjacent rear leg portions of the upper frame and have pivotal connections thereto to cooperate with the front links in supporting the upper frame and chair attached thereto for forward and rearward gliding movement and for positioning in a reclined position; a front rod that extends between the pair of front suspension links and has opposite end portions providing front suspension link stop portions which provide front suspension link stops that are forced against the front base stops of the supports in the reclined position by the rearwardly inclined weight of the chair and its occupant to hold the chair in the reclined position; and a rear rod that extends between the pair of rear suspension links and has opposite end portions providing rear suspension link stop portions which provide rear suspension link stops that are forced against the rear base stops of the supports to limit forward tilting movement.

2. An assembly as in claim 1 wherein each support of the base comprises a bracket having a forward projection on which the associated front suspension link is mounted, each support bracket having a stop portion that functions as the base stop in cooperation with the base stop portion of the other bracket, and each front suspension link having a stop portion that functions as the suspension link stop in cooperation with the stop portion of the other front suspension link.

3. An assembly as in claim 2 wherein the forward projection of each support bracket has a rearward portion with a lower side at which the base stop portion thereof is located and engaged by the link stop portion on the adjacent end of the rod.

4. An assembly as in claim 3 wherein each support bracket also includes a rearward projection having a rearward poriton on which the associated rear suspension link is mounted.

5. An assembly as in claim 4 wherein the rearward projection of each bracket has a forward portion with a lower side at which the rear base stop portion thereof is located.

6. An assembly as in claim 1 wherein the supports of the base include a pair of generally horizontally extending support beams having front and rear ends including downwardly extending legs.

7. An assembly as in claim 6 wherein the support beam and legs of each support are made from a unitary tube.

8. An assembly as in claim 1, 5, or 7 wherein each suspension link has detachable connections to the base and the upper frame such that the support assembly can be stored, shipped, and sold disassembled.

9. An assembly as in claim 8 wherein each detachable connection includes an antifriction bearing and threaded connectors that connect the associated suspension link to the base or the frame.

10. An assembly as in claim 9 wherein the suspension links have opposite ends, each link end including tangs unitary therewith and deformable to secure the antifriction bearing of the associated connection.

11. An assembly as in claim 8 wherein the base includes detachable connections and separable components secured thereby such that the components of the base can be stored, shipped, and sold disassembled.

12. A glider support assembly for a chair or other article of furniture, comprising: a lower floor base including a pair of upwardly projecting support brackets; each bracket having forward and rearward projections; an upper frame including a pair of laterally spaced elongated members that extend horizotnally so as to be attachable to the chair; the upper frame also including front and rear leg portions projecting downwardly from each elongated member in a vertically overlapping relationship with the upwardly projecting brackets; front and rear pairs of suspension links that repsectively extend downwardly from the forward and rearward projections of each bracket to the front and rear leg portions of the upper frame; threaded pivotal connections that connect the suspension links to the projections of the brackets and to the front and rear leg portions of the upper frame to support the frame for forward and rearward gliding movement and for positioning in a reclined position; the forward projection of each bracket having a rearward portion with a lower side that functions as a stop; a front rod that extends between the front suspension links and has ends that function as stops that are forced against the stops on the forward projections of the brackets in the reclined position by the rearwardly inclined weight of the chair and its occupant to hold the chair in the reclined position; the rearward projection of each bracket having a forward portion with a lower side that functions as a stop; and a rear rod that extends between the rear suspension links and has ends that function as stops that engage the stops on the rearward projections of the brackets to limit forward movement of the frame and the attached chair.

13. A glider support assembly as in claim 1 or 12 wherein the upper frame comprises a pair of unitary metal members each of which has an upper horizontal flange that defines the elongated member, and each unitary metal member having a vertical flange that defines the front and rear leg portions.

14. A glider support assembly for a chair or other article of furniture, comprising: a lower floor base including a pair of upwardly projecting support brackets; each bracket having forward and rearward projections; an upper frame including a pair of laterally spaced stamped metal members each of which is unitary and includes a horizontal flange that defines an elongated member that is attachable to the chair; each stamped metal member also having a downwardly projecting vertical flange including front and rear leg portions that have a vertically overlapping relationship with the upwardly projecting brackets; the vertical flange of each stamped metal member having stamped ribs for providing strengthening thereof; front and rear pairs of suspension links that respectively extend downwardly from the forward and rearward projections of each bracket to the front and rear leg portions of the upper frame; threaded pivotal connections that connect the susupension links to the projections of the brackets and to the front and rear leg portions of the upper frame to support the frame for forward and rearward gliding movement and for positioning in a reclined position; the forward projection of each bracket having a rearward portion with a lower side that functions as a stop; a front rod that extends between the front suspension links and has ends that function as stops that are forced against the stops on the forward projections of the brackets in the reclined position by the rearwardly inclined weight of the chair and its occupant to hold the chair in the reclined position; the rearward projection of each bracket having a forward portion with a lower side that functions as a stop; and a rear rod that extends between the rear suspension links and has ends that function as stops that engage the stops on the rearward projections of the brackets to limit forward movement of the frame and the attached chair.

* * * * *

UNITED STATES PATENT AND TRADEMARK OFFICE

CERTIFICATE OF CORRECTION

PATENT NO. : 4,700,920

DATED : October 20, 1987

INVENTOR(S) : John (nmi) Horn

It is certified that error appears in the above-identified patent and that said Letters Patent is hereby corrected as shown below:

Column 8, line 23 , change "o" to --to--:

Column 10, between lines 8 and 9 add the following paragraphs:

the following paragraphs:

--With continuing reference to Figures 13 and 14, the modified version of the upper frame 18' includes a pair of unitary metal members 69' that are spaced laterally from each other. Each of these metal members 69' includes an elongated member 70' provided by an upper horizontal flange 72' having holes 74' for permitting attachment thereof to the associated chair or other similar article of furniture. Each unitary metal member 69' also has a vertical flange 73' having front and rear edge portions that respectively define front and rear leg portions 76f' and 76r'. Upwardly projecting vertical tabs 77' of the vertical flange 73' have the upper hole 78' for attachment to the upper ends of the links, while the lower corners of the vertical flange 73' have the holes 80' for attachment to the lower ends of the links.

The unitary metal members 69' illustrated in Figures 13 and 14 each are preferably made as a stamping to provide the horizontal and vertical flanges 72' and 73'. The vertical flange 73' is also preferably provided with stamped ribs that provides strengthening of the upper frame. These ribs include vertical ribs 150' extending along the front and rear leg portions, X-shaped ribs 152' that extend between

UNITED STATES PATENT AND TRADEMARK OFFICE

CERTIFICATE OF CORRECTION

PATENT NO. : 4,700,920

DATED : October 20, 1987

INVENTOR(S) : John (nmi) Horn

It is certified that error appears in the above-identified patent and that said Letters Patent is hereby corrected as shown below:

the upper and lower ends of the vertical ribs 150', and a lower rib 154' that extends between the lower holes 80' at a location below the upper flange 72' in a parallel extending relationship to the upper flange. As shown in Figure 14, each metal member 69' is also provided with stamped formations 156' spaced along the junction of its horizontal and vertical flanges 72' and 73' to provide strengthening.--

Column 11, line 1, claim 4 change "poriton" to --portion--;

Column 11, line 35, claim 12 , change "horizotnally" to --horizontally--;

Column 11, lines 40 and 41, claim 12 change "repsectively" to --
--respectively--; and Column 12, line 35, claim 14 change "susupension" to
--suspension--.

Signed and Sealed this

Thirty-first Day of May, 1988

*Attest:*

DONALD J. QUIGG

*Attesting Officer*

*Commissioner of Patents and Trademarks*